US007971307B2

(12) United States Patent
Chow

(10) Patent No.: US 7,971,307 B2
(45) Date of Patent: Jul. 5, 2011

(54) DEVICE FOR CLEANING TUBES

(75) Inventor: Kok Heng Chow, Singapore (SG)

(73) Assignee: Hydroactive Veloball International, Singapore (SG)

( * ) Notice: Subject to any disclaimer, the term of this patent is extended or adjusted under 35 U.S.C. 154(b) by 911 days.

(21) Appl. No.: 11/816,470

(22) PCT Filed: Dec. 2, 2005

(86) PCT No.: PCT/SG2005/000413

§ 371 (c)(1),
(2), (4) Date: Aug. 16, 2007

(87) PCT Pub. No.: WO2006/088432

PCT Pub. Date: Aug. 24, 2006

(65) Prior Publication Data

US 2008/0263795 A1 Oct. 30, 2008

(30) Foreign Application Priority Data

Feb. 17, 2005 (SG) ..... 200501166-3

(51) Int. Cl.
*B08B 9/055* (2006.01)

(52) U.S. Cl. ..... 15/104.061; 15/3.51; 165/95

(58) Field of Classification Search ..... 15/3.5, 15/104.061, 3.51; 165/95
See application file for complete search history.

(56) References Cited

U.S. PATENT DOCUMENTS 1,803,126 A * 4/1931 Oberhuber ..... 15/104.061
3,841,397 A 10/1974 Eimer
3,939,065 A 2/1976 Einarsson Ahlfors
4,336,074 A * 6/1982 Dinkelacker ..... 134/8
4,420,038 A 12/1983 Okouchi et al.
4,435,285 A 3/1984 Okouchi et al.
4,498,932 A 2/1985 Kruka
4,554,965 A 11/1985 Bochinski et al.

(Continued)

FOREIGN PATENT DOCUMENTS

DE 19936016 8/2000

(Continued)

OTHER PUBLICATIONS

PCT International Search Report for Hydroactive Veloball International, et al., Dated Mar. 31, 2006, International Application No. PCT/SG20051000413, Filed Dec. 2, 2005.

(Continued)

*Primary Examiner* — Randall Chin
(74) *Attorney, Agent, or Firm* — Law Offices of Albert Wai-Kit Chan, PLLC

(57) ABSTRACT

The present invention provides a device for cleaning tubes, in particular the internal surfaces of tubes in heat exchange systems. The device comprises a mass (2) with an optionally provided central through-hole (10) disposed thereon, and optionally provided a plurality of protrusions (20, 21) mounted and/or moulded on the mass (2). The through-hole (10) is preferably of a conical shape-like configuration. A plurality of first protrusions (20) is disposed in a fin-like arrangement on the mass (2). A plurality of second protrusions (21) is disposed in a spiral arrangement on the mass (2), and the lengths of the second protrusions (21) are relatively longer than the length of the first protrusions (20). The mass may consist of an asymmetrically positioned weighted core (15) of different weights and sizes to provide a variety of relative density to the device and to serve as a geometrical manipulation to impart rotational momentum and random dynamic motion to the device.

15 Claims, 3 Drawing Sheets

U.S. PATENT DOCUMENTS

| | | | | |
|---|---|---|---|---|
| 4,569,097 | A * | 2/1986 | Echols | 15/104.061 |
| 5,105,498 | A * | 4/1992 | Dinkelacker | 15/104.061 |
| 5,388,636 | A | 2/1995 | Peery | |
| 5,482,111 | A | 1/1996 | Bizard | |
| 6,272,713 | B1 * | 8/2001 | Lotwin | 15/104.061 |
| 6,945,316 | B2 * | 9/2005 | Schildmann et al. | 165/95 |

FOREIGN PATENT DOCUMENTS

| | | | |
|---|---|---|---|
| JP | 59-150296 | A | 8/1984 |
| JP | 59150296 | | 8/1984 |
| JP | 61-149797 | A | 7/1986 |
| JP | 2003-080194 | | 3/2003 |
| SU | 1703208 | A1 | 1/1992 |
| WO | WO 02/055174 | | 7/2002 |

OTHER PUBLICATIONS

PCT Written Opinion of the International Searching Authority for Hydroactive Veloball International, et al., Dated Mar. 31, 2006, International Application No. PCT/SG2005/000413, Filed Dec. 2, 2005.

PCT International Preliminary Report on Patentability for Hydroactive Veloball International, et al., Dated Jul. 19, 2007, International Application No. PCT/SG2005/000413, Filed Dec. 2, 2005.

Ing HD.Kludas, 6141 Chemie Technik, 24(1995) Mai, No. 5 Heidelberg, "Moglichkeiten und Grenzen der Molchtechnik" p. 54 to 56, XP 000518032.

U.S. Office Action issued Nov. 14, 2008, for Kok Heng Chow, U.S. Appl. No, 11/572,208, filed Jan. 16, 2007.

U.S. Office Action issued Aug. 12, 2009, for Kok Heng Chow, U.S. Appl. No. 11/572,208, filed Jan. 16, 2007.

Taiwan Office Action for HydroActive Veloball International, (Jun. 30, 2010), Application No. 094124215, Filed Jul. 15, 2005. (with english translation).

Chinese Office Action for HydroActive Veloball International dated Aug. 29 2008, Application No. 200580024036.2, Filed Jun. 16, 2005. (with english translation).

Chinese Office Action for HydroActive Veloball International dated Jun. 19 2009, Application No. 200580024036.2, Filed Jun. 16, 2005. (with english translation).

PCT International Search Report, Mar. 31, 2006, for Kok Heng Chow, Int'l Application No. PCT/SG2005/000413, Filed Dec. 2, 2005.

EPO Communication for Hydroactive Veloball International, dated Mar. 8, 2010,EPO Appl No. 05 752 419.1, filed Jun. 16, 2005.

EPO Communication for Hydroactive Veloball International, EPO Appl No. 05810818.4 dated Nov. 5, 2009.

PCT International Preliminary Examination Report, dated Jun. 27, 2007, for Kok Heng Chow, Int'l Application No. PCT/SG2005/000413, Filed Dec. 2, 2005.

EPO Supplementary Search Report for Hydroactive Veloball International, EPO Appl No. 05810818.4, 2 filed Dec. 2005 , dated Jul. 14, 2008.

Japanese Office Action, Application No. 2007556117(with English translation), mailed Dec. 14, 2010.

* cited by examiner

DEVICE FOR CLEANING TUBES

This application is the National Stage of International Application No. PCT/SG2005/000413, filed Dec. 2, 2005, which claims priority of Singapore Application No. 200501166-3, filed Feb. 17, 2005, the entire disclosures of the preceding applications are incorporated by reference herein in its entirety.

FIELD OF THE INVENTION

The present invention generally relates to devices used for cleaning tubes. In particular, the invention relates to a device that is utilized for cleaning the internal surface of tubes used in heat exchange systems.

BACKGROUND OF THE INVENTION

Heat exchangers are employed throughout various installations in different industries with the primary purpose of gaining or rejecting heat. Some of the most common applications of heat exchangers are found in condensers and evaporators for air conditioning systems and production plants. They are also used in other industries like power plants, refineries, desalination plants and petrochemical installations.

Typically, heat exchange systems achieve the purpose of heat transfer by circulating fluid through a bundle of tubes in the system. The nature of fluids flowing within the tubes can result in fouling, for example accumulation of debris, biological growth, build-up of scale and corrosion. As a result, periodic cleaning of the tubes is essential to maintain optimal performance of the heat exchange system. Techniques of tube cleaning are broadly categorized into on-line and off-line methods.

Off-line cleaning methods, for example rod-and-brush method, chemical cleaning method and high-pressure water jetting method, involve an external cleaning process that requires shutting down the entire heat exchange system before cleaning can be initiated. These off-line cleaning methods are time consuming and labour intensive which make them undesirable for installations requiring short turnaround time. In contrast, on-line cleaning methods utilize cleaning systems that clean heat exchanger tubes while the heat exchange system is in continuous operation. On-line cleaning methods are normally automatic, rendering an extended continuous length run between each regular maintenance shutdown. Hence, they are suitable for implementation into installations that either operates for long hours or sensitive to long system shutdown time.

One type of on-line cleaning method involves circulating multiple foam balls through the heat exchange system, whereby the foam balls will remove and push out fouling deposits in every tube they travel through. U.S. Pat. No. 5,520,712 disclosed an abrasive cleaning ball made from sponge rubber material and constituted by short lengths of abrasive material. J.P. Pat. No. 58,244,423 discloses another type of cleaning ball with an oval spherical shape containing fibers. In J.P. Pat. No. 58,016,125, fibers are fixed on a hollow cleaning ball having small holes. This type of cleaning ball was claimed to be much better than conventional sponge ball with respect to the displacement of water and air. Although the aforesaid cleaning balls are used in cleaning conventional tubes with smooth internal surfaces, they may not be as effective in cleaning evolutionary heat exchange systems that employ enhanced tubes.

Traditionally, tubes used in heat exchange systems are manufactured with a smooth internal surface (smooth bore). With the advancement of heat transfer technologies, new features are incorporated onto the tubes to improve the performance and efficiency of heat exchange systems. These hew improved tubes are known as enhanced tubes and super enhanced tubes. In contrast with the conventional smooth bore tubes, the enhanced tubes have an internal "rifling" feature, which is basically a spiral groove inside the tube. The spiral groove provides more surface area for heat transfer and creates more turbulence in the fluid passing through the tubes. In addition, the enhanced tubes have thinner tube walls in comparison with conventional tubes so as to provide a more efficient overall heat transfer.

Efficiency of the heat exchange system is determined by the cleanliness of the heat transfer surfaces of the tubes. In order to maintain the efficiency and life span of the heat exchange system, it is vital to remove any fouling within the tubes. Over the years, the improvement in heat transfer rates by enhancing the tubes has greatly increased the performance and efficiency of heat exchange systems. However, cleaning these enhanced tubes is more difficult and complicated due to its internal spiral groove. The enhanced tubes are more prone to foulings. Their thin tube walls are also more susceptible to localized pitting failure due to microbiologically influenced corrosion (MIC) and under-deposit corrosion. To prevent these types of corrosion, cleaning of the tubes must be constantly and consistently implemented in order to remove the foulings as they occur.

Currently, conventional foam balls are not effective in removing the foul deposits formed on the spiral grooves of internal rifling in enhanced tubes. The conventional foam balls merely translate through the tubes and do not provide positive physical contact to the spiral grooves to effectively remove any foul deposits accumulated there. In order to fully harness the advantages of an on-line cleaning method, there is an imperative need to have a device that is capable of cleaning the spiral grooves of enhanced tubes efficiently and effectively. This invention satisfies this need by disclosing a device for cleaning tubes, in particular enhanced tubes. Other advantages of this invention will be apparent with reference to the detailed description.

SUMMARY OF THE INVENTION

The present invention relates to a device used for cleaning tubes which comprises a mass with an optionally provided aperture centrally located thereon; and a plurality of optionally provided fin-shaped protrusions and optionally provided filament-like protrusions which are mounted and/or moulded on the said mass. The mass, generally of a spherical shape-like configuration, may be with or without the centrally located aperture and/or the plurality of the fin-shaped protrusions and/or the plurality of filament-like protrusions.

The aperture according to the present invention further comprises a first opening at one end of the aperture and a second opening at the other end of the aperture. The size of the second opening is relatively greater than the first opening and wherein a spiral thread is internally disposed in the said aperture. The aperture in the preferred embodiment is preferably of a conical shape-like configuration.

The plurality of protrusions further comprises a plurality of first protrusions in which the first protrusions are disposed in a fin-shaped arrangement and wherein the first protrusions has a semicircular span and wherein the first opening of the aperture is centrally disposed on the semicircular span of the first protrusions. The plurality of protrusions further comprises a plurality of second protrusions in which the second protrusions are disposed in a filament-like extension with a spiral arrangement on the surface of the mass and wherein the central axis of the spiral arrangement of the second protrusions corresponds to the central axis of the mass. The length of the first protrusions is relatively shorter than the length of the second protrusions.

According to the present invention, the mass is made from incompressible engineered materials and/or compressible elastomeric materials. The mass further comprises a weighted core in which the weighted core is asymmetrically positioned in the mass. The weighted core is preferably made of metal and/or high density engineered plastic materials and wherein the weighted core is configured and designed to have different weights and sizes that provides a variety of relative density to the device. Optionally, a hollow-out portion advantageously designed geometrically and positioned strategically within the mass to manipulate and modify the weight eccentricity and centre of gravity of the mass to impart rotational momentum and random dynamic motion to the device could be provided therein to replace the asymmetrically positioned weighted core. The spiral thread is internally disposed in the central portion of the aperture of the mass and serves as another geometrical manipulation to impart additional rotational momentum to the device.

The smaller size of the first opening and the larger size of the second opening serve as geometrical manipulation to impart differential dynamic fluid pressure across the device. The semicircular span of the first protrusions also serves as a geometrical manipulation and is advantageously positioned to orientate the device. The arrangement of the second protrusions can be advantageously manipulated into other configurations on the surface of the mass and wherein the second protrusions can advantageously be manipulated to be of various lengths. The second protrusions can also be advantageously manipulated to be of various cross-sectional shapes and various cross-sectional areas. The semicircular span of the first protrusions and the second protrusions can be embedded onto the mass with a different engineered material from the mass to form the device. The semicircular span of the first protrusions and the second protrusions can be moulded as a homogeneous unit with the same or different engineered materials of the mass to form the device.

BRIEF DESCRIPTION OF THE DRAWINGS

Preferred embodiments according to the present invention will now be described with reference to the drawings, in which like reference numerals denote like elements.

DETAILED DESCRIPTION OF THE INVENTION

The present invention may be understood more readily by reference to the following detailed description of certain embodiments of the invention.

Numerous contraptions have been devised for the purpose of cleaning tubes. In some industries, tubes are used in heat exchange systems for transferring heat. These tubes can be classified into conventional smooth bore tubes, enhanced tubes and super-enhanced tubes, as was discussed hereinabove. The present invention describes a device that can be used for cleaning these types of tubes. For exemplary purposes, the following descriptions will illustrate the device in cleaning enhanced tubes.

Figure 1:
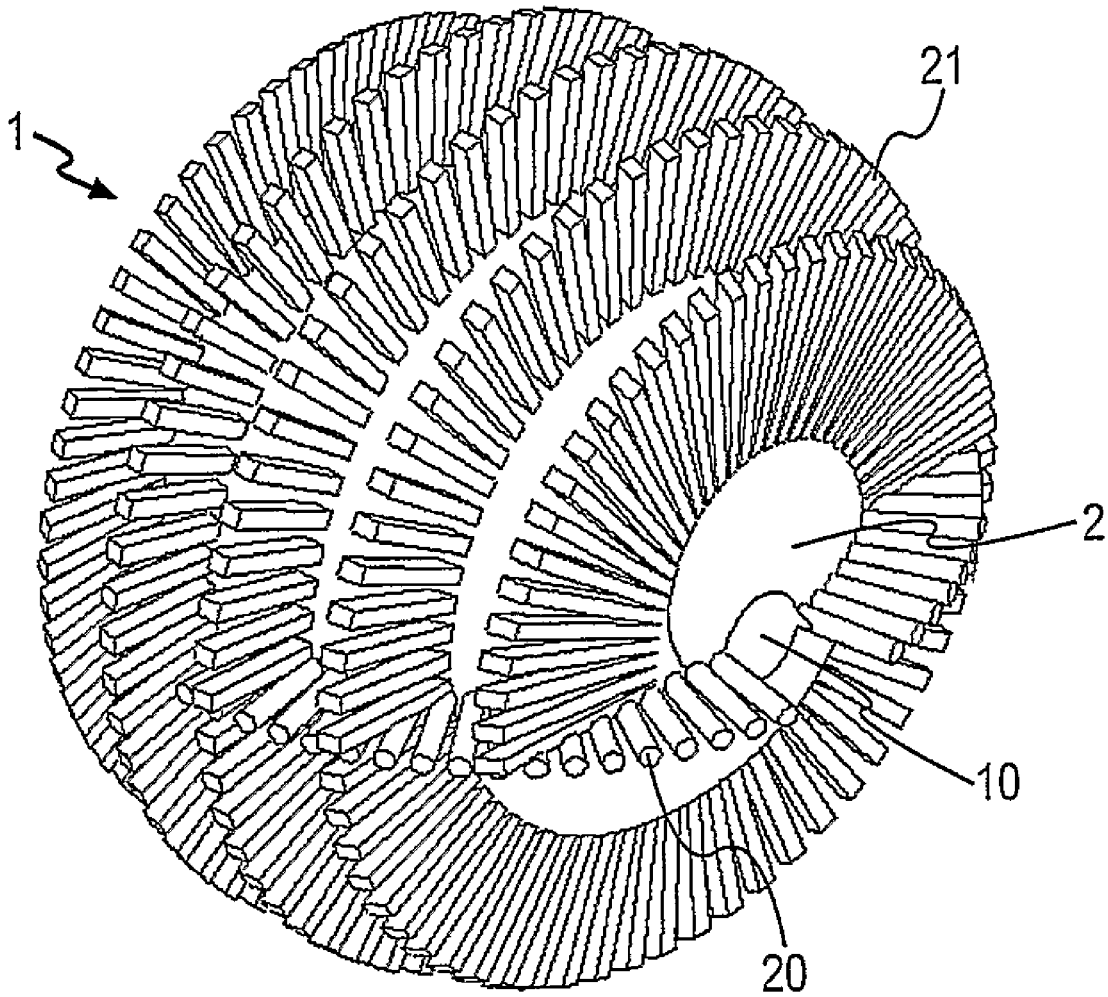
FIG. 1 illustrates a perspective view of the cleaning device.
Figure 3:
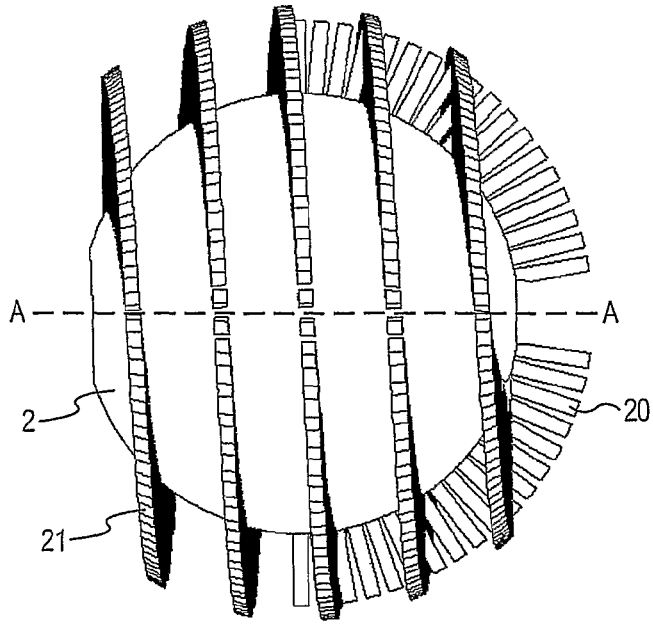
FIG. 3 illustrates a side view of the cleaning device.

FIG. 1 illustrates a perspective view of a cleaning device 1 that comprises a mass 2 with a centrally located aperture 10, wherein the mass has various protrusions 20, 21 embedded and/or moulded thereon. FIG. 3 shows a side view of the cleaning device 1, wherein the protrusions 20 and 21 are disposed in certain patterns that will be discussed subsequently. The mass 2 is preferred to be spherical in shape with a central axis AA, and made from incompressible and/or compressible material, for example engineered plastics and/or elastomeric materials. These types of engineered plastics and elastomeric materials can withstand a wide range of temperatures and are resistant to a variety of chemicals. In alternative embodiments, the mass 2 may be without the centrally located aperture 10 and/or protrusions 20. In yet other alternative embodiments, the shape of the mass 2 may be non-spherical, for example oval-shaped.

Figure 2:
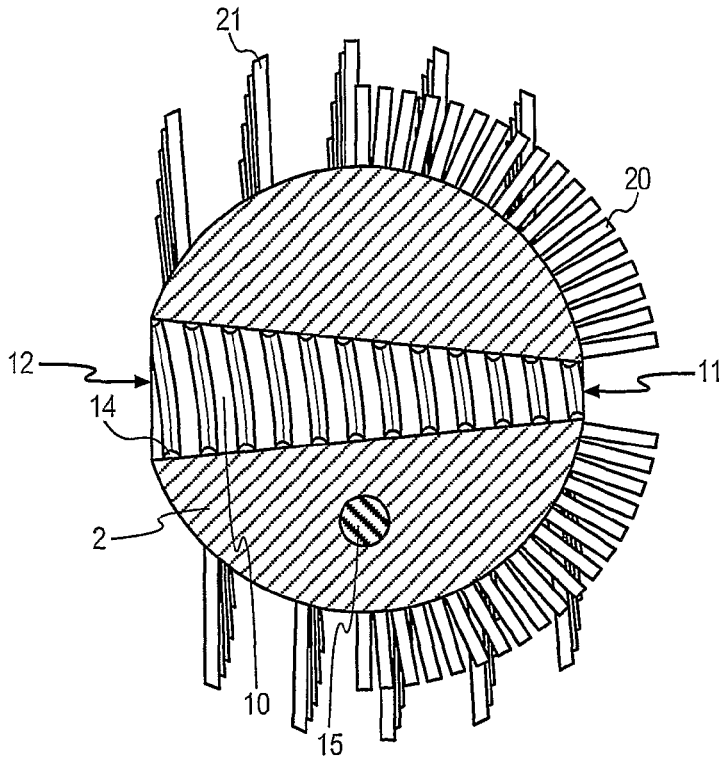
FIG. 2 illustrates a cross-sectional side view of the cleaning device.

FIG. 2 shows a cross-sectional side view of the cleaning device 1, wherein the aperture 10 of the cleaning device 1 is preferably conical in shape to enable fluid to flow into the larger opening 12 and exit from the smaller opening 11. Fluid flowing through the aperture 10 creates a difference in the dynamic fluid pressure between the openings 11 and 12, wherein the dynamic fluid pressure near the region of the larger opening 12 is slightly higher than the dynamic fluid pressure near the smaller opening 11. This differential dynamic fluid pressure facilitates the translation of the cleaning device 1 linearly along the internal of an enhanced tube 30, wherein the translation of the cleaning device 1 is in the same direction as the fluid flow 41 (see FIG. 4). The aperture 10 comprises an internal fin-like spiral thread 14, to manipulate the flow of fluid through the aperture. The spiral thread 14, coupled with the aperture 10 transforms the energy from the fluid flowing through the aperture into a motive force that drives the cleaning device 1 in a spiral motion 40 inside the enhanced tube 30.

Figure 4:
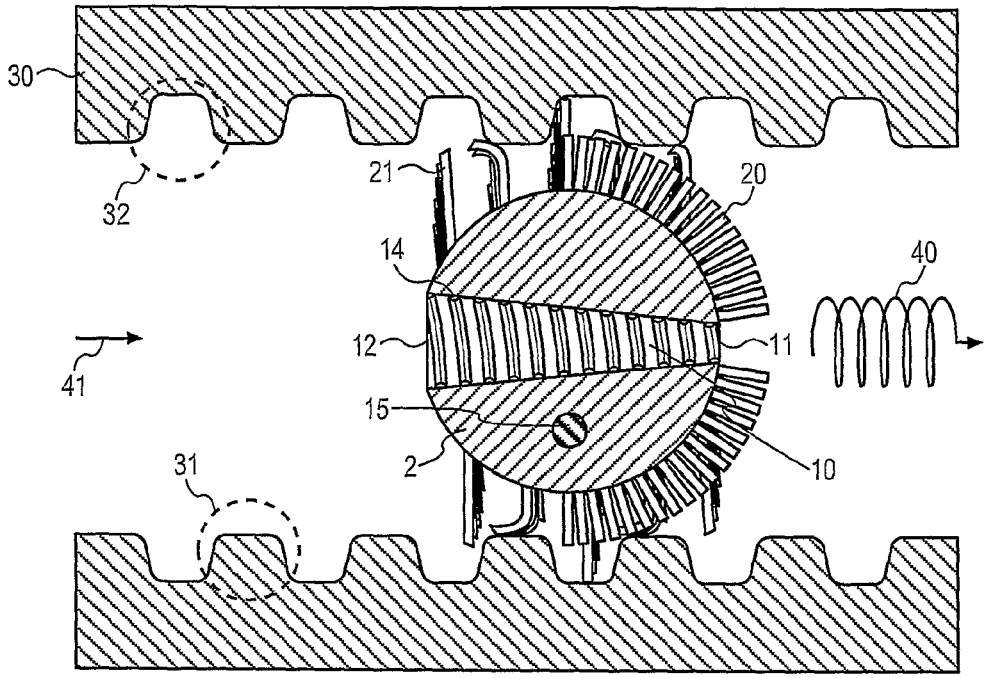
FIG. 4 illustrates a longitudinal cross-sectional view of the cleaning device operating inside an enhanced tube.

FIG. 3 illustrates one embodiment of the cleaning device 1, wherein a plurality of shorter protrusions 20 is mounted and/or moulded on the mass 2 in a fin-shaped arrangement. This fin-shaped arrangement has a semicircular span, wherein the smaller opening 11 is centrally disposed thereon. When the cleaning device 1 enters any tube, the fluid that impinges on the shorter protrusions 20 orientates the cleaning device into the direction of the fluid flow 41 as shown in FIG. 4. In this orientation, the smaller opening 11 of the cleaning device 1 translates through the enhanced tube 30 first, thereby allowing fluid flow 41 through the aperture 10 to create a differential dynamic fluid pressure on the cleaning device 1. In another embodiment, the shorter protrusions may be replaced by several smaller fin-shaped components that are preferably made from the same material as the mass 2. Similarly, these fin-shaped components will form a semicircular span, wherein the smaller opening 11 is centrally disposed thereon. The length of the shorter protrusions 20 can be predetermined so that the shorter protrusions 20 may not inhibit the movement of the cleaning device 1 into the enhanced tube 30.

A plurality of longer protrusions 21 is mounted and/or moulded on the outer surface of the mass 2, wherein the length of the longer protrusions 21 are relatively longer than the length of the shorter protrusions 20. Enhanced tubes 30 are manufactured with an internal rifling, as was discussed hereinabove, wherein the high points and low points of the rifling are known as lands 31 and grooves 32 respectively (see FIG. 4). The lengths of the longer protrusions 21 are advantageously predetermined so that they can reach and clean the grooves 32 of the enhanced tube 30 effectively. In one preferred embodiment, the longer protrusions 21 are mounted and/or moulded in a spiral arrangement on the mass 2 as shown in FIG. 3, wherein the central axis of this spiral arrangement corresponds to the central axis AA. This spiral arrangement of longer protrusions 21 provides an additional mechanism for transforming the energy of fluid flow into a motive force that drives the cleaning device 1 in a spiral motion 40 through the enhanced tube 30. In alternative embodiments, the longer protrusions 21 can advantageously be manipulated into other configurations on the outer surface of the mass 2.

Both types of protrusions 20, 21 can be made from engineered materials with thermal and chemical resistance. The shorter protrusions 20 are advantageously preprocessed to be more rigid than the longer protrusions 21. This is to ensure that the fluid flow 41 is able to impinge on the shorter protrusions 20 substantially to allow the smaller opening 11 to translate through the enhanced tube 30 first. Furthermore, the flexibility of the longer protrusions 21 is engineered to prevent any risks of scratching or damage on the internal surface of the enhanced tubes 30 during cleaning, and to ensure the effective removal of the deposits on the lands 31 and grooves 32.

Figure 5:
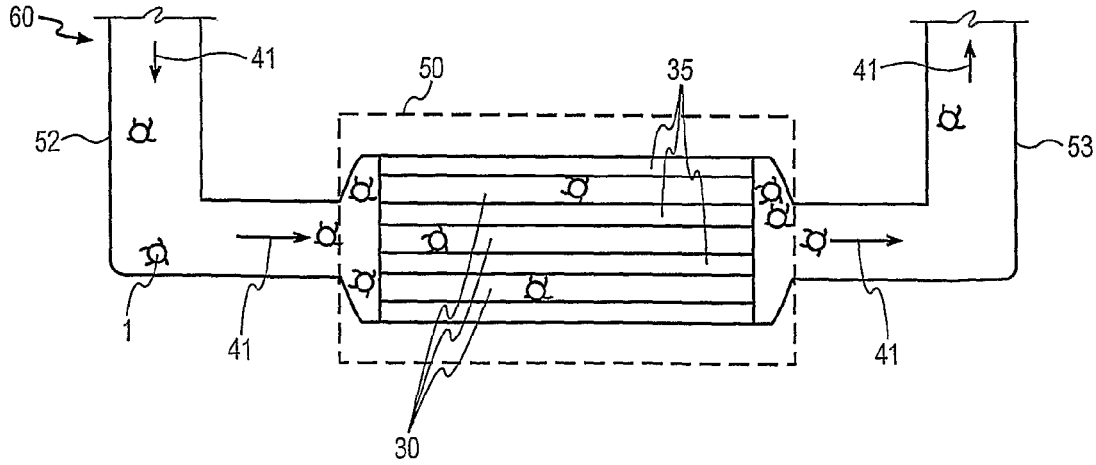
FIG. 5 illustrates a fragmentary cross-sectional view of the heat exchange system.

The operation of the cleaning device 1 in a heat exchange system 60 will now be described. FIG. 5 shows the heat exchange system 60 that comprises an inlet end 52, a discharge end 53 and a heat exchange unit 50. The heat exchange unit 50 further consists of a bundle of enhanced tubes 30 and spaces 35 around the enhanced tubes. Typically, fluid flows from the inlet end 52 into the enhanced tubes 30 and out into the discharge end 53 of the heat exchange system 60, as illustrated by the direction of fluid flow 41. Heat transfer occurs when the fluid flowing through the enhanced tubes 30 exchanges heat energy with another fluid medium in spaces 35 and the walls of the heat exchange unit 50. A circulating pump (not shown) is incorporated within the heat exchange system 60 to generate a pressure differential for circulating the fluid in the heat exchange system. This pressure differential is the main motive force for driving the cleaning device 1 in the heat exchange system 60.

In one embodiment, the mass 2 used in the present invention may consist of an asymmetrically positioned weighted core 15 (see FIG. 4), wherein the weighted core 15 is variable in weight and size. The variation in weight and size of the asymmetrically positioned weighted core 15 allows the specific gravity, center of gravity and weight eccentricity of the cleaning device 1 to be advantageously modified. In another embodiment, mass 2 may replace the asymmetrically positioned weighted core with a hollow-out portion advantageously designed geometrically and positioned strategically within mass 2 to further manipulate and modify the weight eccentricity and center of gravity of the cleaning device 1 to further impart rotational momentum and random dynamic motion to mass 2. In most configurations of heat exchange systems, the plurality of tubes is bundled together. FIG. 5 illustrates the heat exchange system 60, wherein the length of enhanced tubes 30 is laid in a horizontal configuration. The cleaning devices 1 with different specific gravity translate at different levels in the fluid and have a higher tendency to enter various enhanced tubes 30. This provides an even cleaning distribution of the cleaning devices 1 in the heat exchange system 60 that increases the probability of more tubes being cleansed by the cleaning devices 1. Hence, the overall efficiency of the cleaning process can be improved. In yet another embodiment, the mass 2 may comprise engineered materials with different densities for manipulating and modifying the specific gravity, weight eccentricity and physical properties of the cleaning device 1.

When the cleaning device 1 enters a particular enhanced tube 30, the energy of fluid flow 41 acting on the fin-shaped pattern of the set of shorter protrusions 20 maneuvers the cleaning device 1 into an orientation that enables the smaller opening 11 of the mass 2 to enter the internal of the enhanced tube 30 first. This orientation of the cleaning device 1 allows the fluid in the enhanced tube 30 to flow through the larger opening 12 of the aperture 10 in the mass 2 and exit from the smaller opening 11, thereby creating a slight localized dynamic fluid pressure difference that facilitates the translation of the cleaning device 1 towards the end of the enhanced tube 30. FIG. 4 illustrates one exemplary embodiment of the cleaning device 1 operating in an enhanced tube 30. When the cleaning device 1 enters an enhanced tube 30, the circulating pump (not shown) provides the main motive force for driving the cleaning device 1 through the enhanced tube 30. In addition, the aperture 10 of the cleaning device 1 in the enhanced tube 30 creates a differential dynamic fluid pressure on the mass 2, as was discussed hereinabove.

Simultaneously, the internal fin-like thread 14 of the aperture 10 and the arrangement of the longer protrusions 21 serve as mechanisms for transforming the energy of the fluid flow 41 within the enhanced tube 30 into a motive force that drives the cleaning device 1 in a spiral motion 40 inside the enhanced tube 30. The weighted core 15 is also asymmetrically positioned in the mass 2 to facilitate the rotation of the cleaning device 1 when the cleaning device translates in a spiral motion 40 along the internal of the enhanced tube 30. In the other embodiment, the mass 2 that comprises different densities of engineered materials can also facilitate the rotation of the cleaning device 1 when the cleaning device translates in a spiral motion 40. In another embodiment, the asymmetrically positioned weighted core maybe replaced with a hollow-out portion advantageously designed geometrically and positioned strategically within mass 2 to further manipulate and modify the weight eccentricity and center of gravity of the cleaning device 1 to impart rotational momentum and random dynamic motion to mass 2.

During the spiral motion 40 of the cleaning device 1 and the random dynamic impact along the internal surface of the enhanced tubes 30, any foul deposits on the grooves 32 are removed by the longer protrusions 21 and carried out of the enhanced tubes 30 by the fluid flow 41. The methods of extracting the foul deposits that were removed from the grooves are known to those skilled in the art, and will not be discussed herein. The size of the cleaning device 1 and the length, geometrical shape and physical dimensions of the protrusions 20, 21 can be engineered to suit the sizes of tubes or pipes in other industries, for example pigging applications in oil and gas industries, sewage treatment plants, desalination plants, ship tankers, airlines, cooling water-lines and others.

While the foregoing descriptions of the present invention presented certain preferred embodiments, it is to be understood that these descriptions are exemplary and are not intended to limit the scope of the present invention. It is expected that those skilled in the art will perceive variations which, while differing from the foregoing, do not depart from the spirit and scope of the invention as herein described and claimed. In the present invention the first protrusions (20) and the second protrusions (21) can be advantageously manipulated to be of various cross-sectional shapes and various cross-sectional areas.

The invention claimed is:

1. A device for cleaning an inner surface of a tube, said device having a mass (2) of a substantially spherical shape comprising (i) a through-hole (10) axially disposed therethrough, wherein the through-hole (10) tapers from a first opening at a first side of the mass to a second opening at a second side of the mass, wherein the diameter of the second opening is larger than the diameter of the first opening;

(ii) a plurality of first protrusions spanning symmetrically on either side of the first opening in a fin-shaped semicircular arrangement and radially extending from the mass of the device, wherein the fin-shaped semicircular arrangement serves to orientate the device so that the through-hole is aligned with the direction of fluid flow; and (iii) a plurality of second protrusions (21) disposed in an axially spiral arrangement on the surface of the mass (2), wherein the axis of the spiral arrangement of the second protrusions (21) corresponds to the axis of the mass (2) along said through-hole (10), and wherein the length of the first protrusions is relatively shorter than the length of the second protrusions.

2. The device according to claim 1, wherein the through-hole (10) is a truncated conical shape.

3. The device according to claim 1, wherein a thread (14) is disposed along the inner surface of the through-hole (10).

4. The device according to claim 1 wherein the first protrusions (20) are in the form of continuous fin-shape ridges (18, 19).

5. The device as claimed in claim 1, wherein the mass (2) further comprises a weighted core (15) in which the weighted core (15) is asymmetrically positioned in the mass (2) to manipulate and modify the weight eccentricity and centre of gravity of the mass (2) to impart rotational momentum and random dynamic motion to the device.

6. The device as claimed in claim 5, where the weighted core (15) is made of metal and/or high density engineered plastic materials with predetermined weight according to the desired relative density of the device and wherein a hollow out portion is provided eccentrically to complement the weighted core (15)'s eccentricity.

7. The device as claimed in claim 1, wherein a hollow-out portion advantageously designed geometrically and positioned strategically within the mass (2) to manipulate and modify the weight eccentricity and centre of gravity of the mass (2) to impart rotational momentum and random dynamic motion to the device.

8. The device as claimed in claim 1, wherein the arrangement of the second protrusions (21) on the surface of the mass (2) is predetermined to provide a desired fluid dynamics translation to the device.

9. The device as claimed in claim 8, wherein the fluid dynamic translation provided by the second protrusions' (21) arrangement complements the translation provided by a thread (14) disposed along an inner surface of the through-hole (10).

10. The device as claimed in claim 1, wherein the first protrusions (20) are provided in a predetermined cross-sectional shape and cross-sectional area.

11. The device as claimed in claim 1, wherein the second protrusions (21) are provided in a predetermined cross-sectional shape and cross-sectional area.

12. The device as claimed in claim 1, wherein the plurality of first protrusions (20) and the plurality of second protrusions (21) are embedded onto the mass (2) as separately fabricated elements made from engineered material which is different from the mass (2) to form the device.

13. The device as claimed in claim 1, wherein the plurality of first protrusions (20) and the plurality of second protrusions (21) are moulded as an integral article with the same or different engineered materials of the mass (2) to form the device.

14. A fluid flow tube system, including a heat exchanger, having an internal surface to be cleaned and including at least a device according to claim 1.

15. A machine including a heat exchanger flow tube system according to claim 14 wherein at least a device according to claim 1 is deployed.

* * * * *